US006588050B1

(12) United States Patent
Aiken

(10) Patent No.: US 6,588,050 B1
(45) Date of Patent: Jul. 8, 2003

(54) FLOOR CLEANER

(76) Inventor: Michael D. Aiken, 2901 Roundtable Ct., Charleston, SC (US) 29414

( * ) Notice: Subject to any disclaimer, the term of this patent is extended or adjusted under 35 U.S.C. 154(b) by 0 days.

(21) Appl. No.: 09/876,966

(22) Filed: Jun. 8, 2001

(51) Int. Cl.[7] ..... A46L 11/30
(52) U.S. Cl. ..... 15/320; 15/334; 15/373; 15/401
(58) Field of Search ..... 15/320, 334, 328, 15/373, 401

(56) References Cited

U.S. PATENT DOCUMENTS

| | | | | | |
|---|---|---|---|---|---|
| 1,601,774 | A | * | 10/1926 | Scheffer | 15/415.1 |
| 1,970,293 | A | | 8/1934 | Fairfax | |
| 3,101,505 | A | * | 8/1963 | Belicka et al. | 15/320 |
| 3,150,394 | A | | 9/1964 | Sauers | |
| 3,402,420 | A | * | 9/1968 | Schaeffer | 15/320 |
| 3,460,184 | A | | 8/1969 | Dyer | |
| 3,550,181 | A | * | 12/1970 | Dolan et al. | 15/320 |
| 3,699,607 | A | | 10/1972 | Putt | |
| 3,833,961 | A | * | 9/1974 | Fortman et al. | 15/320 |
| 3,879,789 | A | * | 4/1975 | Kasper | 15/320 |
| 3,883,961 | A | * | 5/1975 | Limouze | 434/12 |
| 3,959,844 | A | | 6/1976 | Cyphert | |
| 4,073,031 | A | | 2/1978 | Schwartz | |
| 4,109,342 | A | | 8/1978 | Vermillion | |
| 4,164,055 | A | * | 8/1979 | Townsend | 15/321 |
| 4,245,371 | A | | 1/1981 | Satterfield | |
| 4,349,935 | A | * | 9/1982 | Knestele | 15/320 |
| 4,393,537 | A | | 7/1983 | Reprogle et al. | |
| 4,446,595 | A | | 5/1984 | Nakada et al. | |
| 4,577,364 | A | * | 3/1986 | Demetriades | 15/230.14 |
| 4,759,094 | A | | 7/1988 | Palmer et al. | |
| 4,809,397 | A | * | 3/1989 | Jacobs et al. | 15/320 |
| 5,133,107 | A | | 7/1992 | Mac Donald | |
| 5,319,828 | A | * | 6/1994 | Waldhauser et al. | 15/320 |
| 5,383,251 | A | | 1/1995 | Whitaker et al. | |
| 5,465,456 | A | | 11/1995 | Fellhauer et al. | |
| 5,623,743 | A | * | 4/1997 | Burgoon et al. | 15/320 |
| 5,813,086 | A | | 9/1998 | Ueno et al. | |
| 6,076,228 | A | | 6/2000 | Aiken | |
| 6,260,232 | B1 | * | 7/2001 | Nelson et al. | 15/322 |

* cited by examiner

*Primary Examiner*—Theresa T. Snider

(57) ABSTRACT

A floor cleaner for providing enhanced fluid application, scrubbing, and fluid extraction from floor surfaces. The floor cleaner includes a housing having a top and a bottom, and a front and a rear. A scrubbing system is provided for applying fluid to a floor surface and rubbing the floor surface. The scrubbing system has a lowered position for contacting the floor surface below the housing and a raised position for positioning the scrubbing system out of contact with the floor system. A vacuum system is provided for removing soiled fluid from the floor surface. Optionally included is an auxiliary cleaning assembly for applying and extracting fluids. The auxiliary cleaning assembly comprises a cleaning wand for applying fluid to and rubbing confined areas, and cleaning wand having first and second portions pivotally mounted together such that the second portion may be pivoted between a stored position and a deployed position.

14 Claims, 6 Drawing Sheets

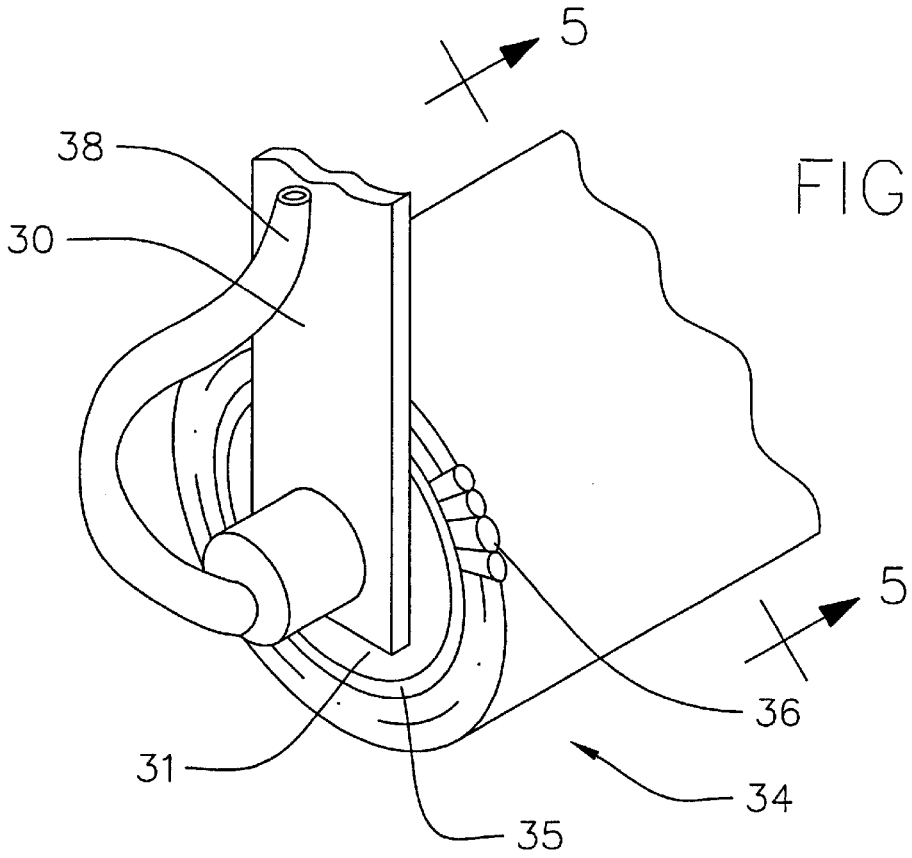
FIG. 4
FIG. 5
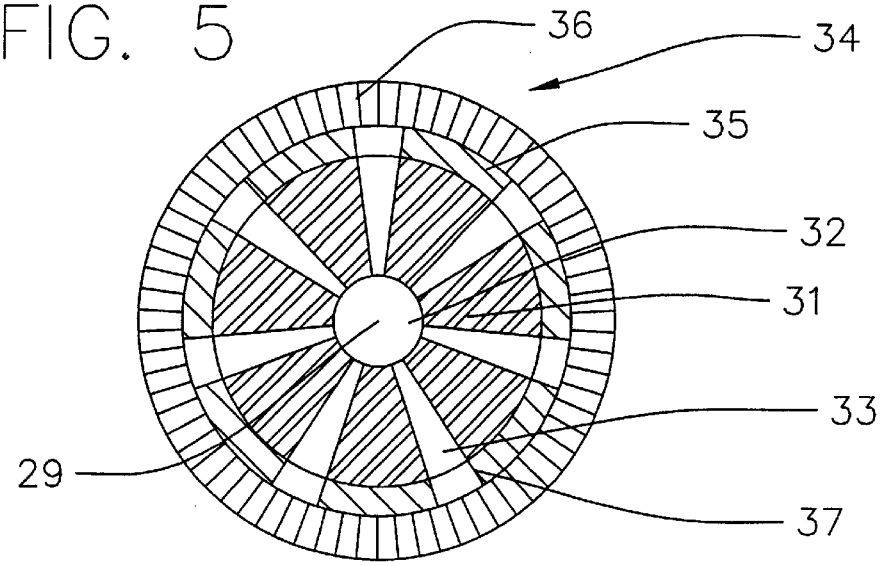

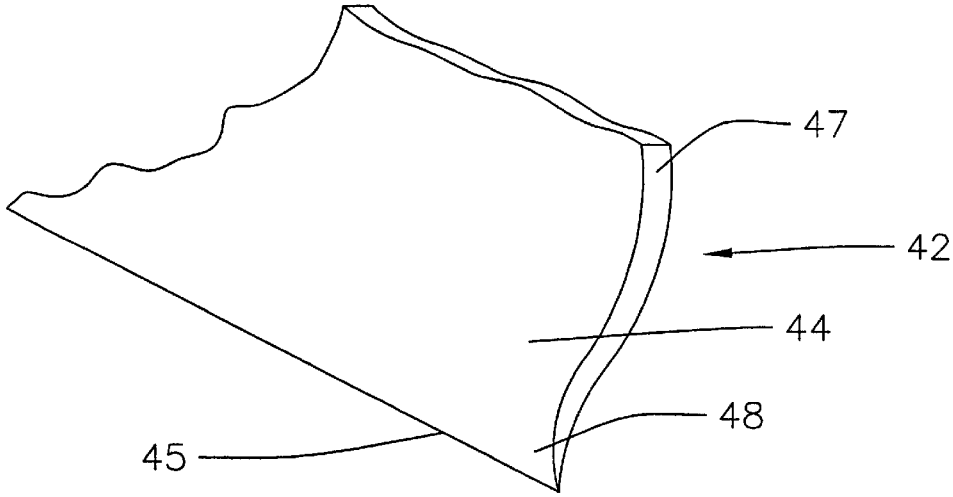
FIG. 6
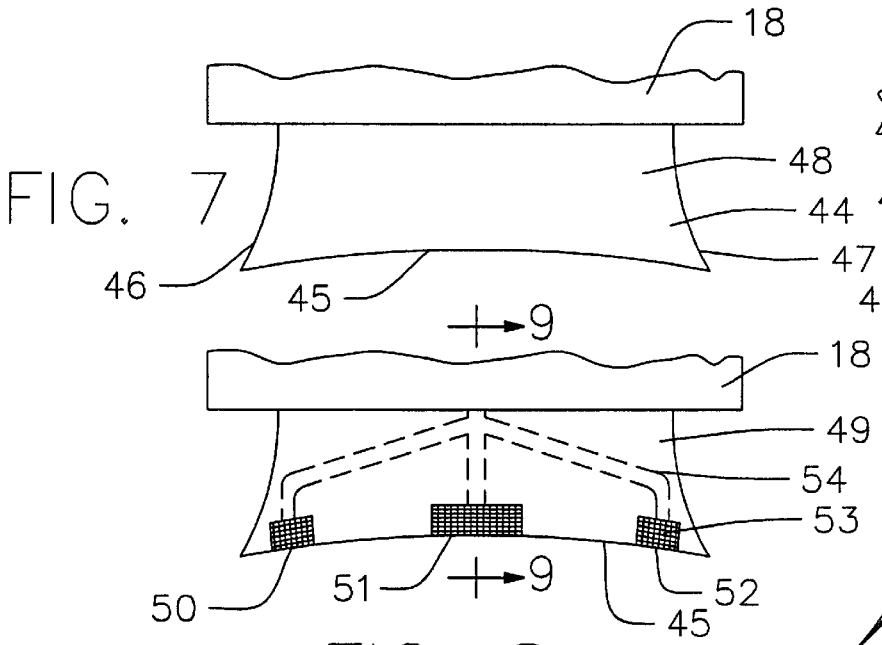
FIG. 7
FIG. 8
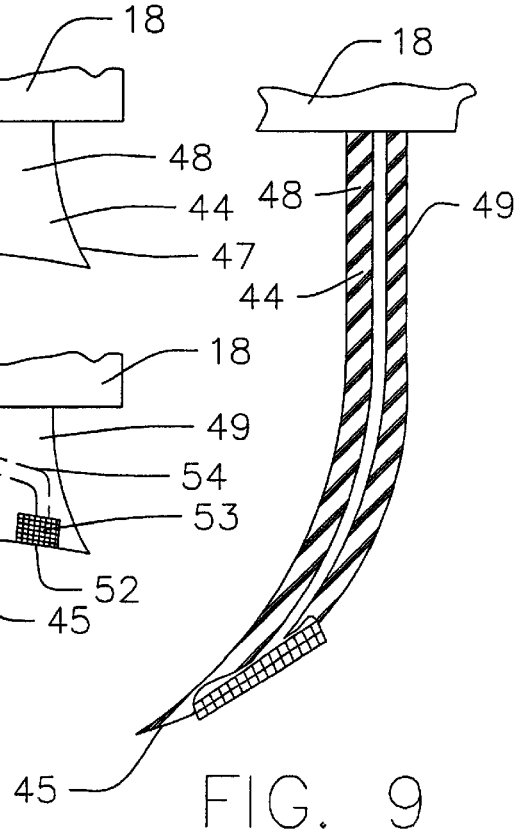
FIG. 9

FLOOR CLEANER

BACKGROUND OF THE INVENTION

1. Field of the Invention

The present invention relates to floor cleaner systems and more particularly pertains to a new floor cleaner for providing enhanced fluid application, scrubbing, and fluid extraction from floor surfaces.

2. Description of the Prior Art

The use of floor cleaner systems is known in the prior art. One highly useful floor cleaner is disclosed in my patent entitled "FLOOR CLEANER WITH VACUUM DRYER", U.S. Pat. No. 6,076,228. The floor cleaner disclosed in that patent includes an apparatus for applying cleaning fluid to a floor surface, an apparatus for scrubbing the fluid moistened floor surface, and an apparatus for vacuuming or extracting the cleaning fluid and soil material from the floor surface. Although the cleaner disclosed in that patent is highly effective for cleaning floor surfaces, improvements in the invention have been devised for simplifying and further enhancing the effectiveness of the cleaner, especially for cleaning confined floor areas where the entire floor cleaner unit will not fit.

The floor cleaner according to the present invention substantially improves upon the floor cleaner disclosed in U.S. Pat. No. 6,076,228, and in so doing provides an apparatus primarily developed for the purpose of providing enhanced fluid application, scrubbing, and fluid extraction from floor surfaces.

SUMMARY OF THE INVENTION

In view of the foregoing disadvantages inherent in the known types of floor cleaner systems now present in the prior art, the present invention provides a new floor cleaner construction wherein the same can be utilized for providing enhanced fluid application, scrubbing, and fluid extraction from floor surfaces.

To attain this, the present invention generally comprises a housing having a top and a bottom, and a front and a rear. A scrubbing system is mounted on the housing for applying fluid to a floor surface and rubbing the floor surface. The scrubbing system has a lowered position for contacting the floor surface below the housing and a raised position for positioning the scrubbing system out of contact with the floor system. A vacuum system is mounted on the housing for removing soiled fluid from the floor surface. Optionally included is an auxiliary cleaning assembly for applying and extracting fluids. The auxiliary cleaning assembly mounted on the housing comprises a cleaning wand for applying fluid to and rubbing confined areas. The cleaning wand has first and second portions pivotally mounted together such that the second portion may be pivoted between a stored position and a deployed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective view of a broken away end portion of the fluid application system.

FIG. 5 is a schematic sectional view of the cylindrical brush/fluid applicator taken along line 5—5 of FIG. 4.

FIG. 6 is a schematic front perspective view of a broken away portion of the extractor shield of the present invention.

FIG. 7 is a schematic front view of the extractor shield of the present invention.

FIG. 8 is a schematic rear view of the extractor shield of the present invention.

FIG. 9 is a schematic sectional view of the extractor shield of the present invention taken along line 9—9 of FIG. 8.

DESCRIPTION OF THE PREFERRED EMBODIMENT

Figure 1:
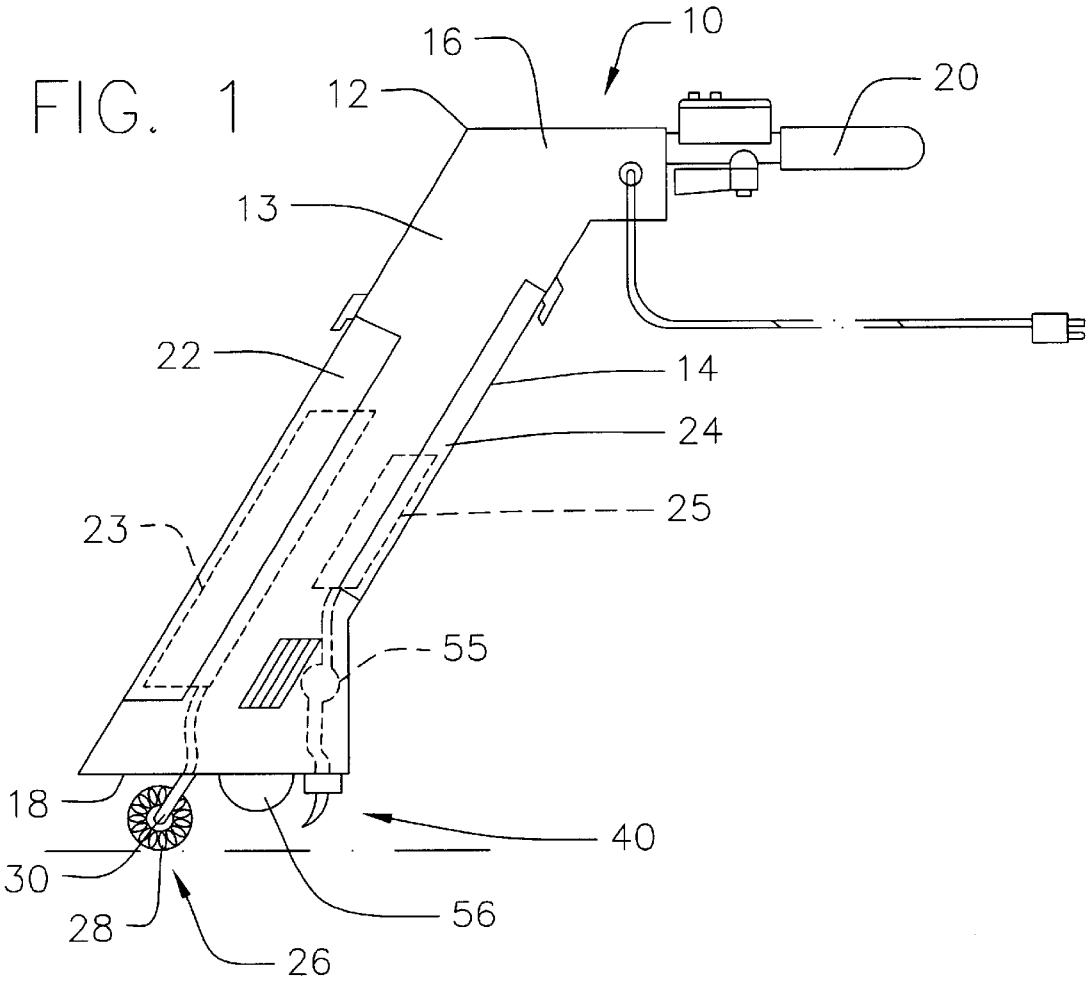
FIG. 1 is a side view of a floor cleaner according to the present invention with cylindrical brush of the scrub assembly in an extended position.
Figure 2:
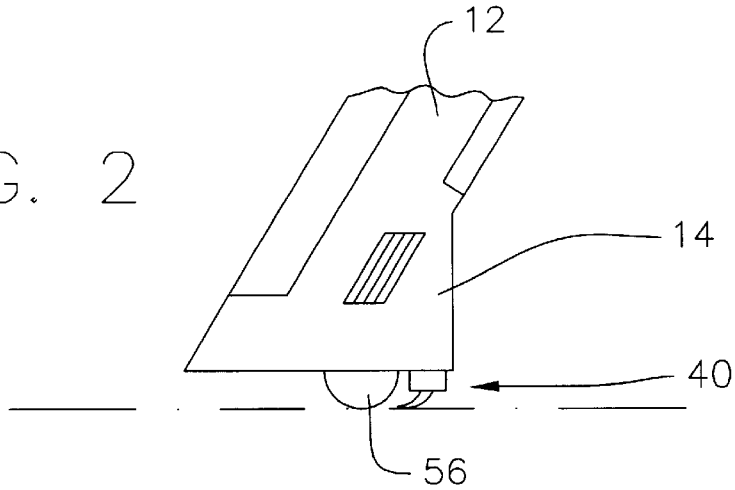
FIG. 2 is a side view of the present invention with the cylindrical brush of the scrub assembly in a retracted orientation.
Figure 3:
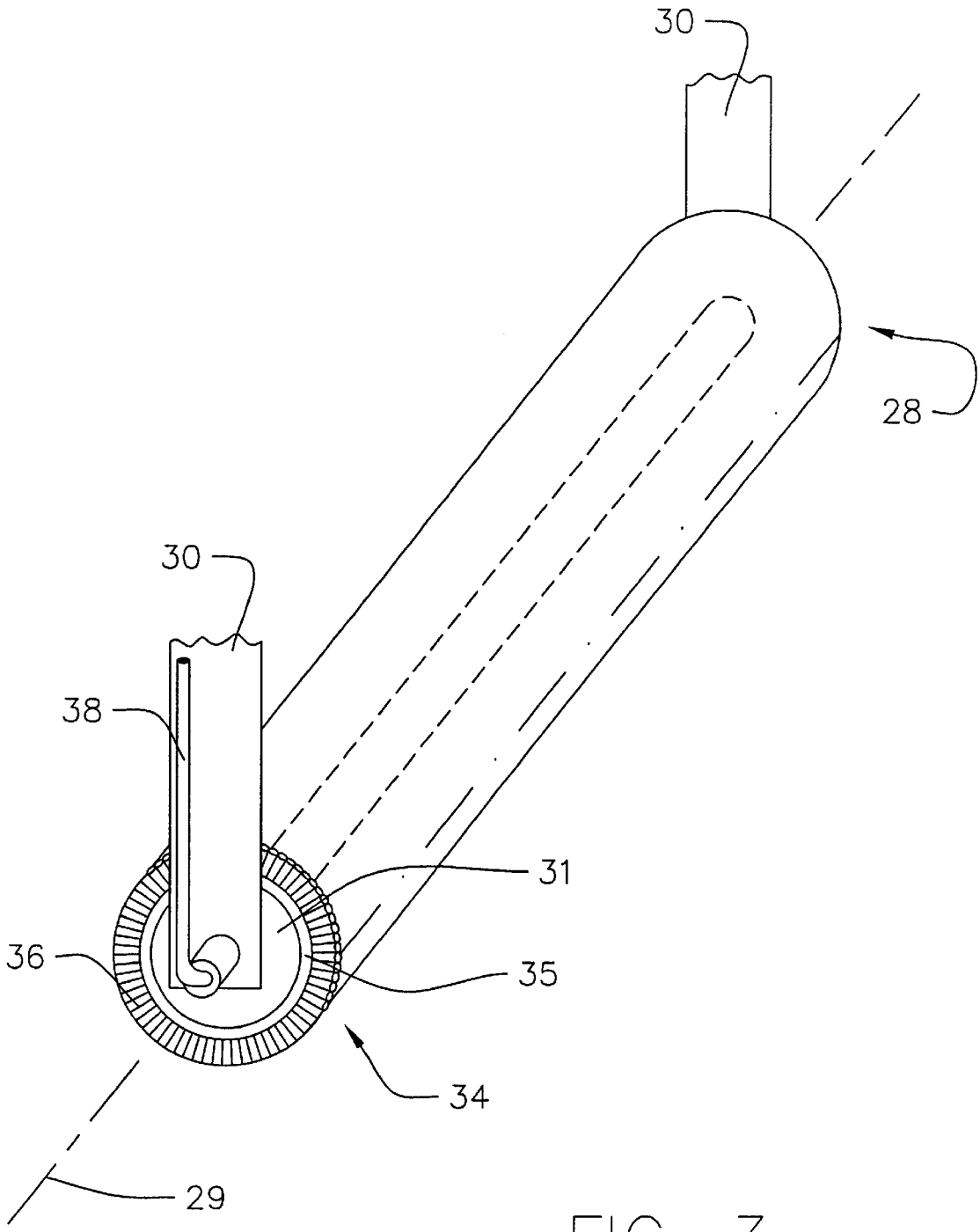
FIG. 3 is a side perspective view of the cylindrical brush broken away from the cleaner and showing detail of the fluid application system.
Figure 10:
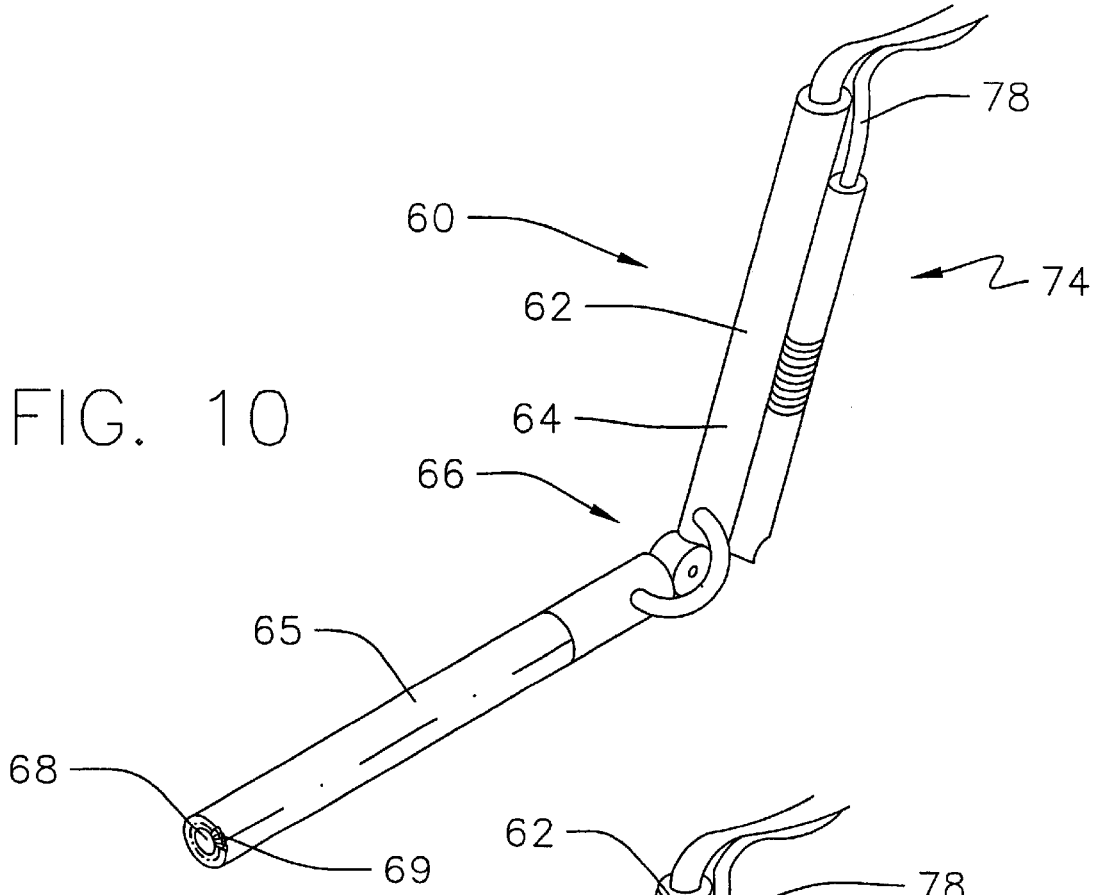
FIG. 10 is a schematic perspective view of the auxiliary cleaning assembly of the present invention in the deployed position.
Figure 11:
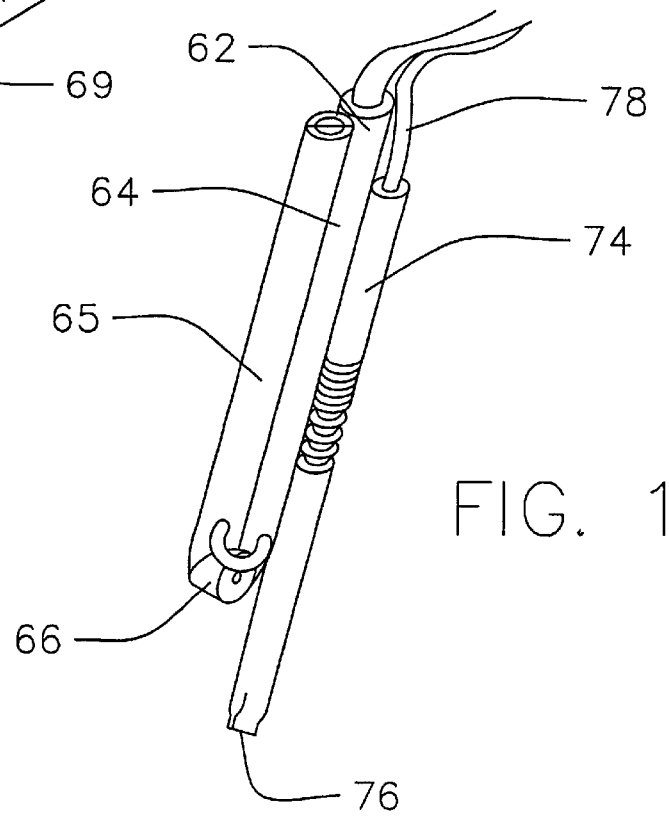
FIG. 11 is a schematic perspective view of the auxiliary cleaning assembly of the present invention in the stored position.

With reference now to the drawings, and in particular to FIGS. 1 through 12 thereof, a new floor cleaner embodying the principles and concepts of the present invention and generally designated by the reference numeral 10 will be described.

The floor cleaner of the invention includes a housing 12 having a front 13 and a rear 14, and a top 18 and a bottom 16. The housing has a front wall, a rear wall, and a pair of side walls that define an interior space. The top has at least one grip 20, and preferably two grips, coupled to the top. The grips extend rearwardly from the housing for being gripped by a user for supporting the housing in a generally upright orientation during use. The front of the housing has a first compartment 22 with a cleaning fluid tank 23 located therein, and the rear of the housing has a second compartment 24 with a recovery tank 25 located therein. Optionally, the housing 12 may have an angled configuration that permits a user to walk behind the housing and support the grip of the housing while avoiding striking his or her feet against the rear face of the housing, thus permitting a relatively normal gait for the user.

The floor cleaner 10 of the invention includes a scrubbing system 26 for applying fluid to a floor surface and rubbing the floor surface, a vacuum system 40 for removing soiled fluid from the floor surface, and optionally includes an auxiliary cleaning assembly 60 for applying and extracting fluids in confined spaces.

The scrubbing system 26 of the invention is characterized by having a lowered position (see FIG. 1) for contacting the floor surface below the housing and a raised position (see FIG. 2) for positioning the scrubbing system out of contact with the floor system. The scrubbing system 26 includes a pair of mounting arms 30 that depend or extend downwardly from the bottom of the housing, and the pair of mounting arms are transversely spaced with respect to the longitudinal length of the housing.

The scrubbing system also includes a brush assembly 28 being rotatably mounted on the mounting arms 30 such that the brush assembly extends between the pair of mounting arms. It should be noted that the brush assembly of the scrub assembly is rotated by means such as, for example, a belt or chain, that is also mounted on a pulley that is in turn connected to a motor. In use, the brush assembly, mounting arms, belt, and motor are preferably mounted on a carriage that is slidably movable in a recess formed in the bottom of the housing.

The brush assembly 28 includes a central core 31 rotatably mounted on the pair of mounting arms 28. The central core 31 has a rotational axis 29, and a substantially cylindrical exterior surface about the rotational axis. The central core has a central bore 32 extending along a portion of the rotational axis. Significantly, a plurality of passages 33 extend from the central bore to the exterior surface for passing fluid from the central bore through the plurality of passages to the exterior surface of the central core for a purpose which will be described below.

The brush assembly 28 also includes a scrubbing sleeve 34 removably mounted on the central core 31. The scrubbing sleeve 34 comprises a tube portion 35 with an inner surface that is adapted for sliding over and abutting against the exterior surface of the central core. The tube portion 35 has an outer surface with a plurality of filaments 36 mounted thereon, and the filaments extend outwardly from the outer surface of the tube portion to form a brushing structure. Illustratively, the filaments 36 comprise a material that is the same or similar to that employed for conventional mop heads for enhanced fluid retention in the filaments during scrubbing.

Significantly, the tube portion 35 has a plurality of holes 37 passing therethrough for permitting fluid to pass through the tube portion to the filaments. Thus, fluid passing through the central bore 32 and plurality of passages 33 of the central core 30 is able to move through the plurality of holes 37 in the tube portion to reach the filaments for applying the fluid to the floor surface to be scrubbed with the filaments. A supply conduit 38 is provided for supplying fluid to the central bore of the central core. The supply conduit 38 is in fluid communication with the cleaning fluid tank 23 and in communication with the central bore of the central core for moving fluid therebetween. A portion of the supply conduit 38 extends along one of the mounting arms 28 for joining to the central bore of the central core.

The vacuum system 40 of the invention comprises an extractor shield 42 mounted on the bottom of the housing 12 and extended downwardly from the housing. The extractor shield 42 is located rearward of the scrubbing system on the housing for retrieving fluid dispensed by the scrubbing assembly and soil carried by that fluid. The extractor shield 42 most preferably comprises a resiliently ITS flexible panel 44 which has a lower edge 45 and lateral edges 46, 47, and front 48 and a rear 49. The panel may be formed from a relatively rigid material that provides some resistance to bending. The panel extends downwardly from the housing and forwardly in the direction of the scrubbing assembly, and the panel may be arcuate such that the panel curves forwardly as the panel extends downwardly from the housing. The panel has a transverse width between the lateral edges, and in one embodiment of the invention the transverse width tapers smaller or narrower from the lower edge toward the housing. The panel has a thickness, and optionally the thickness of the panel tapers thinner from the housing toward the lower edge for enhancing the flexibility of a lower portion of the panel relative to an upper portion of the panel near the housing. Illustratively, the lower edge of the panel may extend approximately 3 from the bottom of the housing, and may have a thickness of approximately ⅜ inch thick adjacent to the bottom of the housing.

A plurality of suction ports 50, 51, 52 are mounted on the panel for removing fluid from the floor surface. The suction ports are formed or mounted on the rear 49 of the panel 44 adjacent to the lower edge 45 of the panel. In one preferred embodiment of the invention, one 50, 52 of the plurality of suction ports is located toward each of the lateral edges of the panel, and one 51 of the ports is located substantially centrally between the lateral edges of the panel. A screen 53 may be mounted over each of the suction ports for blocking relatively large debris from entering the port and possibly obstructing the port. A plurality of suction conduits 54 may be provided, with each of the suction conduits extending between and in fluid communication with one of the suction ports and the recovery tank in the housing. A suction pump 55 is in fluid communication with the suction conduits for pulling fluid through the suction conduits from the ports and moving the fluid to the recovery tank.

Floor engaging means 56 may be provided for supporting the housing on a floor surface. The floor engaging means are rotatable for facilitating movement of the housing across the floor surface. The floor engaging means is adapted to support the housing at a predetermined distance from the floor surface. The floor engaging means may be located on the housing between the scrubbing system and the vacuum system. In one embodiment of the invention, the floor engaging means comprises a spherical ball rotatably mounted on the bottom of the housing. The spherical ball protrudes from the bottom of the housing for maintaining the vacuum assembly a predetermined distance from the floor when the brush assembly is retracted into the housing.

Optionally, the auxiliary cleaning assembly 60 may be provided for applying and extracting fluids. The auxiliary cleaning assembly comprises a cleaning wand 62 for applying fluid to and rubbing confined areas. The cleaning wand 62 may have first 64 and second 65 portions pivotally mounted together such that the second portion may be pivoted between a stored position and a deployed position. The stored position (see FIG. 10) is characterized by the second portion being rotated into a location adjacent to the first portion, and the deployed position (see FIG. 11) is characterized by the second portion being rotated away from the first portion and generally extending away from the first portion. The first 64 and second 65 portions are joined at a pivot joint 66. The second portion 65 has a central core 68 and a scrubbing sleeve 69 removably mounted on the central core. In a structure similar to the brush assembly, while not being rotatable. The scrubbing sleeve 69 has a plurality of filaments 70 mounted thereon. A supply conduit 72 is provided for supplying fluid to the central core from the cleaning fluid tank. Optionally, the cleaning wand may be removably clipped to a side of the housing 12 for storage during periods of non use, while keeping the wand c convenient.

The auxiliary cleaning assembly 60 may also include an extractor tube 74 for removing soiled fluid from confined areas, especially after fluid has been applied to the confined area and scrubbed by the scrubbing sleeve. The extractor tube may be mounted on the first portion 64 of the cleaning wand. The extractor wand has a section that is selectively extendable by and preferably beyond the pivot joint of the cleaning wand (see FIG. 11). The section is selectively retractable so as not to extend by and beyond the pivot joint. The retractability may be accomplished by, for example, an accordion structure between sections of the tube that may be alternately extended or retracted. The extractor tube has an open end 76 into an interior of the extractor tube, and may have a flattened end. The interior of the extractor tube is in communication with the suction pump 55 of the vacuum system for permitting fluid to be suctioned through the open end of the extractor tube and pumped into the recovery tank. For this purpose, a conduit 78 fluidly connects the interior of the extractor tube to the suction pump.

Optionally, the floor cleaner 10 may incorporate a rechargeable battery positioned in the housing such that a power cord for the cleaner 10 is not required during use of the device.

Figure 12:
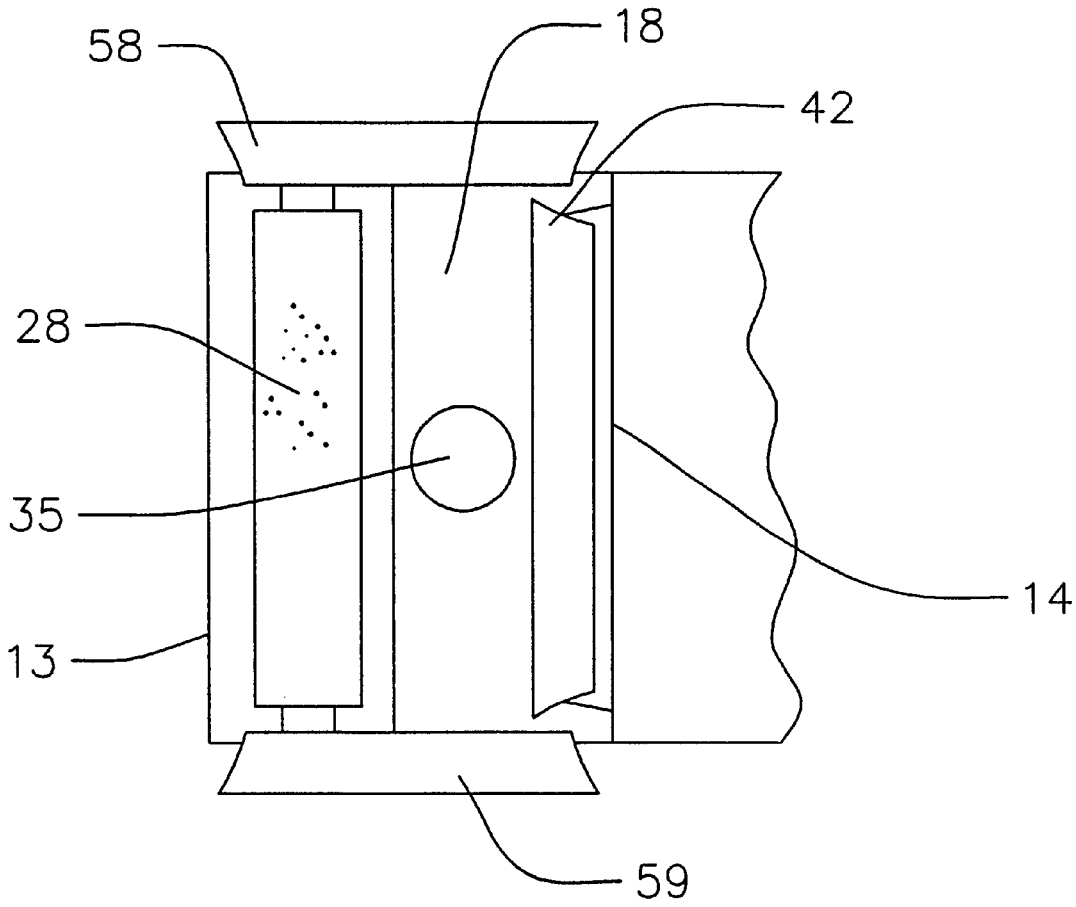
FIG. 12 is a schematic bottom view of the cleaner showing an optional multiple extractor shield configuration.

As a further option, the floor cleaner of the invention may be provided with multiple extractor shields (see FIG. 12). A pair of side extractor shields 58, 59 may be mounted on the bottom 18 of the housing at positions lateral to the primary extractor shield 42. The side extractor shields may be generally located in planes that are generally perpendicular to the plane of the primary extractor shield, and the side extractor shields may be positioned relatively forwardly of the primary extractor shield, such that a zone between the multiple shields is created below the housing for trapping fluids.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A floor cleaner comprising:

a housing having a top and a bottom, a front and a rear;

a scrubbing system for applying fluid to a floor surface, the scrubbing system having a lowered position for contacting the floor surface below the housing and a raised position for positioning the scrubbing system out of contact with the floor system; and a vacuum system for removing soiled fluid from the floor surface;

wherein the vacuum system comprises an extractor shield mounted on the bottom of the housing and extending downwardly from the housing;

wherein the extractor shield comprises a resiliently flexible panel with a lower edge and lateral edges, the panel having a front and a rear; and wherein a plurality of suction ports are formed on the panel for removing fluid from the floor surface, the suction ports being located on the rear of the panel adjacent to the lower edge of the panel.

2. The floor cleaner of claim 1 wherein the panel has a transverse width between the lateral edges, the transverse width tapering smaller from the lower edge toward the housing.

3. The floor cleaner of claim 1 wherein the panel has a thickness, the thickness of the panel tapering thinner from the housing toward the lower edge.

4. The floor cleaner of claim 1 wherein a screen is mounted over each of the suction ports for blocking relatively large debris from entering the ports.

5. The floor cleaner of claim 1 wherein the housing has a front wall, a rear wall, and a pair of side walls defining an interior space, the top having at least one grip coupled thereto and extending rearwardly therefrom for being gripped by a user for maintaining the housing in a generally upright orientation, the front of the housing having a first compartment with a cleaning fluid tank located therein, the rear of the housing having a second compartment with a recovery tank located therein.

6. The floor cleaner of claim 1 wherein the extractor shield comprises a primary extractor shield, and additionally comprising a pair of side extractor shields.

7. The floor cleaner of claim 6 wherein the pair of side extractor shields are positioned generally perpendicular to the primary extractor shield.

8. The floor cleaner of claim 1 wherein the housing has a front wall, a rear wall, and a pair of side walls defining an interior space, the top having at least one grip coupled thereto and extending rearwardly therefrom for being gripped by a user for maintaining the housing in a generally upright orientation, the front of the housing having a first compartment with a cleaning fluid tank located therein, the rear of the housing having a second compartment with a recovery tank located therein;

wherein the scrubbing system includes:

a pair of mounting arms depending from the housing, the pair of mounting arms being transversely spaced;

a brush assembly being rotatably mounted on the mounting arms such that the brush assembly extends between the pair of mounting arms, the brush assembly including:

a central core rotatably mounted on the pair of mounting arms, the central core having a rotational axis, the central core having a substantially cylindrical exterior surface, the central core having a central bore along a portion of said rotational axis, a plurality of passages extending from the central bore to the exterior surface for passing fluid from the central bore through the plurality of passages to the exterior surface of the central core;

a scrubbing sleeve removably mounted on the central core, the scrubbing sleeve comprising a tube portion with an inner surface for abutting against the exterior surface of the central core, the tube portion having an outer surface with a plurality of filaments mounted thereon for extending outwardly from the outer surface of the tube portion, the tube portion having a plurality of holes therethrough for permitting fluid to pass through the tube portion to the filaments;

a supply conduit for supplying fluid to the central bore of the central core, the supply conduit being in fluid communication with the cleaning fluid tank and in communication with the central bore of the central core, a portion of the supply conduit extending along one of the mounting arms;

wherein the vacuum system comprises:

the extractor shield being located rearward of the scrubbing system on the housing, the extractor shield, comprising:

the panel extending downwardly and forwardly, the panel being arcuate, the panel having a transverse width, the transverse width tapering smaller from the lower edge toward the housing, the panel having a thickness, the thickness of the panel tapering thinner from the housing toward the lower edge;

one of the ports being mounted toward each of the lateral edges of the panel, one of the ports being mounted substantially centrally between the lateral edges of the panel;

a screen mounted over each of the suction ports for blocking relatively large debris from entering the ports;

a plurality of suction conduits, each of the suction conduits extending between and in fluid communication with one of the suction ports and the recovery tank;

a suction pump in fluid communication with the suction conduits for pulling fluid through the suction conduits from the ports and moving the fluid to the recovery tank;

floor engaging means for supporting the housing on a floor surface, the floor engaging means being rotatable for facilitating movement of the housing across the floor surface, the floor engaging means being adapted to support the housing a predetermined distance from the floor surface, the floor engaging means being located between the scrubbing system and the vacuum system, the floor engaging means comprising a spherical ball rotatably mounted on the bottom of the housing; and an auxiliary cleaning assembly for applying and extracting fluids, the auxiliary cleaning assembly being connected to the scrubbing system and the vacuum system, the auxiliary cleaning assembly comprising:

a cleaning wand for applying fluid to and rubbing confined areas, the cleaning wand having first and second portions pivotally mounted together such that the second portion may be pivoted between a stored position and a deployed position, the stored position being characterized by the second portion being rotated into a location adjacent to the first portion, the deployed position being characterized by the second portion being rotated away from the first portion and generally extending away from the first portion, the first and second portions being joined at a pivot joint, the second portion having a central core and a scrubbing sleeve removably mounted on the central core, the scrubbing sleeve having a plurality of filaments mounted thereon, a supply conduit for supplying fluid to the central core from the cleaning fluid tank;

an extractor tube for removing soiled fluid from confined areas, the extractor tube being mounted on the first portion of the cleaning wand, the extractor tube having a section selectively extendable beyond the pivot joint of the cleaning wand the section being selectively retractable so as not to extend beyond the pivot joint, the extractor tube having an open end into an interior of the extractor tube, the interior of the extractor tube being in communication with a suction pump of the vacuum system for permitting fluid to be suctioned through the open end of the extractor tube and pumped into the recovery tank, a conduit fluidly connecting the interior of the extractor tube to the suction pump.

9. A floor cleaner comprising:

a housing having a top and a bottom, a front and a rear;

a scrubbing system for applying fluid to a floor surface, the scrubbing system having a lowered position for contacting the floor surface below the housing and a raised position for positioning the scrubbing system out of contact with the floor system; and a vacuum system for removing soiled fluid from the floor surface;

wherein the vacuum system comprises an extractor shield mounted on the bottom of the housing and extending downwardly from the housing;

wherein the extractor shield comprises a resiliently flexible panel with a lower edge and lateral edges, the panel having a front and a rear;

wherein the panel extends downwardly and forwardly, the panel being arcuate between the housing and the lower edge.

10. A floor cleaner comprising:

a housing having a top and a bottom, a front and a rear;

a scrubbing system for applying fluid to a floor surface, the scrubbing system having a lowered position for contacting the floor surface below the housing and a raised position for positioning the scrubbing system out of contact with the floor system; and a vacuum system for removing soiled fluid from the floor surface;

wherein the scrubbing system includes a pair of transversely spaced mounting arms depending from the housing, and a brush assembly being rotatably mounted on the mounting arms such that the brush assembly extends between the pair of mounting arms; and wherein the brush assembly includes a central core rotatably mounted on the pair of mounting arms and a scrubbing sleeve removably mounted on the central core.

11. The floor cleaner of claim 10 wherein the central core has a rotational axis, the central core having an exterior surface, the central core having a central bore along a portion of said rotational axis, a plurality of passages extending from the central bore to the exterior surface for passing fluid from the central bore through the plurality of passages to the exterior surface of the central core.

12. The floor cleaner of claim 11 wherein the scrubbing sleeve comprising a tube portion with an inner surface for abutting against the exterior surface of the central core, the tube portion having an outer surface with a plurality of filaments mounted thereon for extending outwardly from the outer surface of the tube portion, the tube portion having a plurality of holes therethrough for permitting fluid to pass through the tube portion to the filaments.

13. A floor cleaner comprising:

a housing having a top and a bottom, a front and a rear;

a scrubbing system for applying fluid to a floor surface, the scrubbing system having a lowered position for contacting the floor surface below the housing and a raised position for positioning the scrubbing system out of contact with the floor system; and a vacuum system for removing soiled fluid from the floor surface;

an auxiliary cleaning assembly for applying and extracting fluids, the auxiliary cleaning assembly being connected to the scrubbing system and the vacuum system, the auxiliary cleaning assembly comprising a cleaning wand for applying fluid to and rubbing confined areas;

wherein the cleaning wand has first and second portions pivotally mounted together such that the second portion may be pivoted between a stored position and a deployed position, the stored position being characterized by the second portion being rotated into a location adjacent to the first portion, the deployed position being characterized by the second portion being rotated away from the first portion and generally extending away from the first portion, the first and second portions being joined at a pivot joint, the second portion having a central core and a scrubbing sleeve removably mounted on the central core, the scrubbing sleeve having a plurality of filaments mounted thereon, a supply conduit for supplying fluid to the central core from a cleaning fluid tank.

14. The floor cleaner of claim 13 additionally comprising an extractor tube for removing soiled fluid from confined areas, the extractor tube being mounted on the first portion of the cleaning wand, the extractor tube having a section selectively extendable beyond the pivot joint of the cleaning wand, the section being selectively retractable so as not to extend beyond the pivot joint, the extractor tube having an open end into an interior of the extractor tube, the interior of the extractor tube being in communication with a suction pump of the vacuum system for permitting fluid to be suctioned through the open end of the extractor tube and pumped into a recovery tank, a conduit fluidly connecting the interior of the extractor tube to the suction pump.

* * * * *